US012486550B2

(12) United States Patent
Jeong

(10) Patent No.: US 12,486,550 B2
(45) Date of Patent: Dec. 2, 2025

(54) DIFFERENTIAL HEAT TREATMENT METHOD FOR FORMING ROLLER

(71) Applicant: Sang Seok Jeong, Dasan-myeon (KR)

(72) Inventor: Sang Seok Jeong, Dasan-myeon (KR)

( * ) Notice: Subject to any disclaimer, the term of this patent is extended or adjusted under 35 U.S.C. 154(b) by 0 days.

(21) Appl. No.: 18/881,621

(22) PCT Filed: Jun. 7, 2023

(86) PCT No.: PCT/KR2023/007757

§ 371 (c)(1),
(2) Date: Jan. 6, 2025

(87) PCT Pub. No.: WO2024/010232

PCT Pub. Date: Jan. 11, 2024

(65) Prior Publication Data

US 2025/0257421 A1 Aug. 14, 2025

(30) Foreign Application Priority Data

Jul. 7, 2022 (KR) ..... 10-2022-0083886

(51) Int. Cl.
*C21D 9/38* (2006.01)
*C21D 1/18* (2006.01)

(52) U.S. Cl.
CPC ..... *C21D 9/38* (2013.01); *C21D 1/18* (2013.01)

(58) Field of Classification Search
CPC ... C21D 9/28; C21D 9/30; C21D 9/32; C21D 9/36; C21D 9/38; C21D 9/40
See application file for complete search history.

(56) References Cited

U.S. PATENT DOCUMENTS 5,527,402 A * 6/1996 Ganesh ..... C22F 1/00 148/902
6,179,936 B1 1/2001 Yoshida et al.
(Continued)

FOREIGN PATENT DOCUMENTS

CN 111549205 A 8/2020
JP 2000-239744 A 9/2000
(Continued)

OTHER PUBLICATIONS

KR Decision to Grant Dated Sep. 20, 2022 as received in Application No. 10-2022-0083886.

*Primary Examiner* — Kyle A Cook
(74) *Attorney, Agent, or Firm* — Maschoff Brennan

(57) ABSTRACT

The present disclosure includes a differential heat treatment method for a forming roller including an outer circumferential surface heat treatment step for heating the outer circumferential surfaces of roller units. The method may additionally include a first natural cooling step for naturally cooling until the surface temperature reaches 100-150° C., an inner circumferential surface heat treatment step for heating the inner circumferential surfaces of the roller units. The method may additionally include a second cooling step for naturally cooling until the roller units reach a room temperature state after the inner circumferential heat treatment. Further, the method may include an inspection and release step for inspecting the hardness of the outer circumferential surface and the inner circumferential surface after the second cooling and releasing when the hardness is within an error range.

3 Claims, 7 Drawing Sheets

(56) References Cited

U.S. PATENT DOCUMENTS

| | | | | |
|---|---|---|---|---|
| 2010/0263771 | A1* | 10/2010 | Kim | F16C 33/62 420/104 |
| 2012/0225761 | A1* | 9/2012 | Gaspard | C22C 38/04 148/334 |
| 2014/0345353 | A1* | 11/2014 | Oda | C22C 38/001 148/522 |
| 2018/0036983 | A1* | 2/2018 | Yoshitani | B22D 19/16 |
| 2018/0257134 | A1* | 9/2018 | Yuan | C22C 37/08 |
| 2020/0088040 | A1* | 3/2020 | Shah | C21D 9/0068 |
| 2021/0277948 | A1* | 9/2021 | De Jong | F16C 33/64 |
| 2021/0348247 | A1* | 11/2021 | Kitamura | C21D 9/40 |
| 2022/0325669 | A1* | 10/2022 | Piazza | C21D 1/76 |

FOREIGN PATENT DOCUMENTS

| | | | |
|---|---|---|---|
| JP | 3880086 | B2 | 2/2007 |
| JP | 2018-090837 | A | 6/2018 |
| KR | 10-1992-0000522 | B1 | 1/1992 |
| KR | 10-2447382 | B1 | 9/2022 |

* cited by examiner

FIG. 7

Summary table of mechanical property values of surface hardening heat treatment test

| Classification | | Test segment type | | | |
|---|---|---|---|---|---|
| | | Test Segment 1<br>320L x 260W x 156T | Test Segment 2<br>320L x 260W x 156T | Test Segment 3<br>400L x 240W x 143T | Test Segment 4<br>400L x 240W x 143T |
| | | 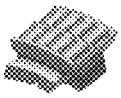 <br>Tempering: at 580 ℃ | 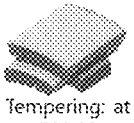 <br>Tempering: at 580 ℃ | 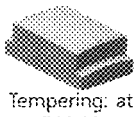 <br>Tempering: at 580 ℃ | 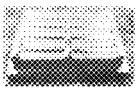 <br>Tempering: at 200 ℃ |
| Hardness (HRC) | Surface hardness distribution | 57.5~59.4HRC | 54.3 ~ 57.2 HRC | 49.6 ~ 52.1HRC | 58.2 ~ 60.2HRC |
| | Differential hardness distribution (Top→ bottom) | 59.2 → 39.6 HRC | 56.3 → 31.0 HRC | 52.2 → 39.2 HRC | 58.2 → 35.6 HRC |
| Impact toughness (J/cm2) | Surface portion | - | 20.9<br>21.1 | 7.4<br>9.9 | 4.7<br>6.9 |
| | Center portion | - | 11.9<br>13.1 | 7.2<br>8.2 | 9.7<br>8.1 |
| | Bottom portion | - | 11.6<br>10.0 | 7.3<br>7.3 | 7.4<br>9.7 |

DIFFERENTIAL HEAT TREATMENT METHOD FOR FORMING ROLLER

TECHNICAL FIELD

The present invention relates to a differential heat treatment method for a forming roller, and more particularly, to a differential heat treatment method for a forming roller, capable of extending a lifespan of the forming roller while improving productivity by performing a differential heat treatment on an inner circumferential surface of the forming roller that has the inner circumferential surface requiring moderate strength and durability and an outer circumferential surface requiring high strength.

BACKGROUND ART

In general, two forming rollers are combined into one set so as to be engaged with each other to rotate, and a desired forming product is manufactured in a rotation process.

The forming rollers are used in sites requiring high strength, such as a formed coal rapid freezing manufacturing device that compresses raw coal for manufacture and a steel waste briquetting device that forms a recycled formed body to recycle steel waste such as steel slag, sludge, and oxide scale generated from industrial sites such as steel companies, or in a pill manufacturing device that forms pills or foods having a spherical shape and a die-cutting device that cuts a sheet-type material such as paper, fiber, a resin film, a metal sheet, a PCB, an FPCB, and an optical film.

In particular, as shown in FIG. 1, a forming roller 10 used in an industrial site that requires high strength may have a structure in which a plurality of roller units 20 are coupled to an outer circumferential surface of a shaft 30 around the shaft 30, and although a shape of the forming roller 10 varies depending on the purpose of use, rigidity and durability that the forming roller 10 has to have may be the same.

In other words, since the forming roller 10 used in the industrial site that requires high strength has an outer circumferential surface requiring strength that is greater than or equal to a predetermined level, the forming roller 10 is subjected to a heat treatment at a high temperature.

Strength of an inner circumferential surface as well as the strength of the outer circumferential surface may be increased according to the heat treatment. However, when the strength of the inner circumferential surface is increased, a component (e.g., a shaft) that rotates while making surface contact may be abraded (worn away).

In order to solve such a problem, there may be a method of manufacturing the roller unit 20 of the forming roller by dividing the roller unit 20 into two portions, which are an outer circumferential surface portion and an inner circumferential surface portion. However, in this case, a manufacturing cost may rise rapidly.

Therefore, a forming roller required in the art may be a product in which strength of an outer circumferential surface has to be greater than or equal to a predetermined level, and strength of an inner circumferential surface has a significant difference with the strength of the outer circumferential surface in consideration of durability of a component that rotates while making surface contact.

DISCLOSURE

Technical Problem

Accordingly, the present invention has been devised to recognize the problems described above and propose a solution thereto, and an object of the present invention is to provide a differential heat treatment method for a forming roller, capable of extending a lifespan of the forming roller while improving productivity due to the extended lifespan by performing a differential heat treatment on inner and outer circumferential surfaces to obtain a forming roller in which an inner circumferential surface of a roller unit requires moderate strength and durability according to a component interworking therewith, and an outer circumferential surface of the roller unit requires high strength.

Technical Solution

To achieve the object described above, according to the present invention, there is provided a differential heat treatment method for a forming roller, the differential heat treatment method including: an outer circumferential surface heat treatment step (S100) of heating an outer circumferential surface (21) of a roller unit (20) constituting a forming roller (10) such that a heat treatment is performed under a condition of a temperature of 1150 to 1200° C. for 25 to 35 minutes; a first natural cooling step (S200) of performing, after the outer circumferential surface heat treatment, natural cooling until a surface temperature reaches 100 to 150° C.; an inner circumferential surface heat treatment step (S300) of heating, after the natural cooling, an inner circumferential surface (22) of the roller unit (20) such that a heat treatment is performed under a condition of a temperature of 680 to 730° C. for 35 to 45 minutes; a second cooling step (S400) of performing, after the inner circumferential surface heat treatment, natural cooling until the roller unit reaches a room temperature state; and an inspection and release step (S500) of inspecting, after the second cooling, hardness of the outer circumferential surface and the inner circumferential surface to perform release when the hardness is within an error range.

In this case, a material of the roller unit (20) may be one selected from high-speed tool steel, alloy tool steel, and special-purpose steel.

In addition, a heat source in the heating process may be one selected from gas or electricity.

Advantageous Effects

According to a differential heat treatment method for a forming roller of the present invention, which has characteristics described above, a heat treatment may be performed such that outer and inner circumferential surfaces of a roller unit constituting the forming roller have a significant difference in hardness, so that a lifespan of the forming roller can be extended, and productivity can be improved due to the extended lifespan.

DESCRIPTION OF DRAWINGS

FIG. 7 is a result summary table summarizing results of FIGS. 3 to 6.

BEST MODE

Hereinafter, a differential heat treatment method for a forming roller according to an exemplary embodiment of the present invention will be described with reference to the accompanying drawings.

Figure 1:
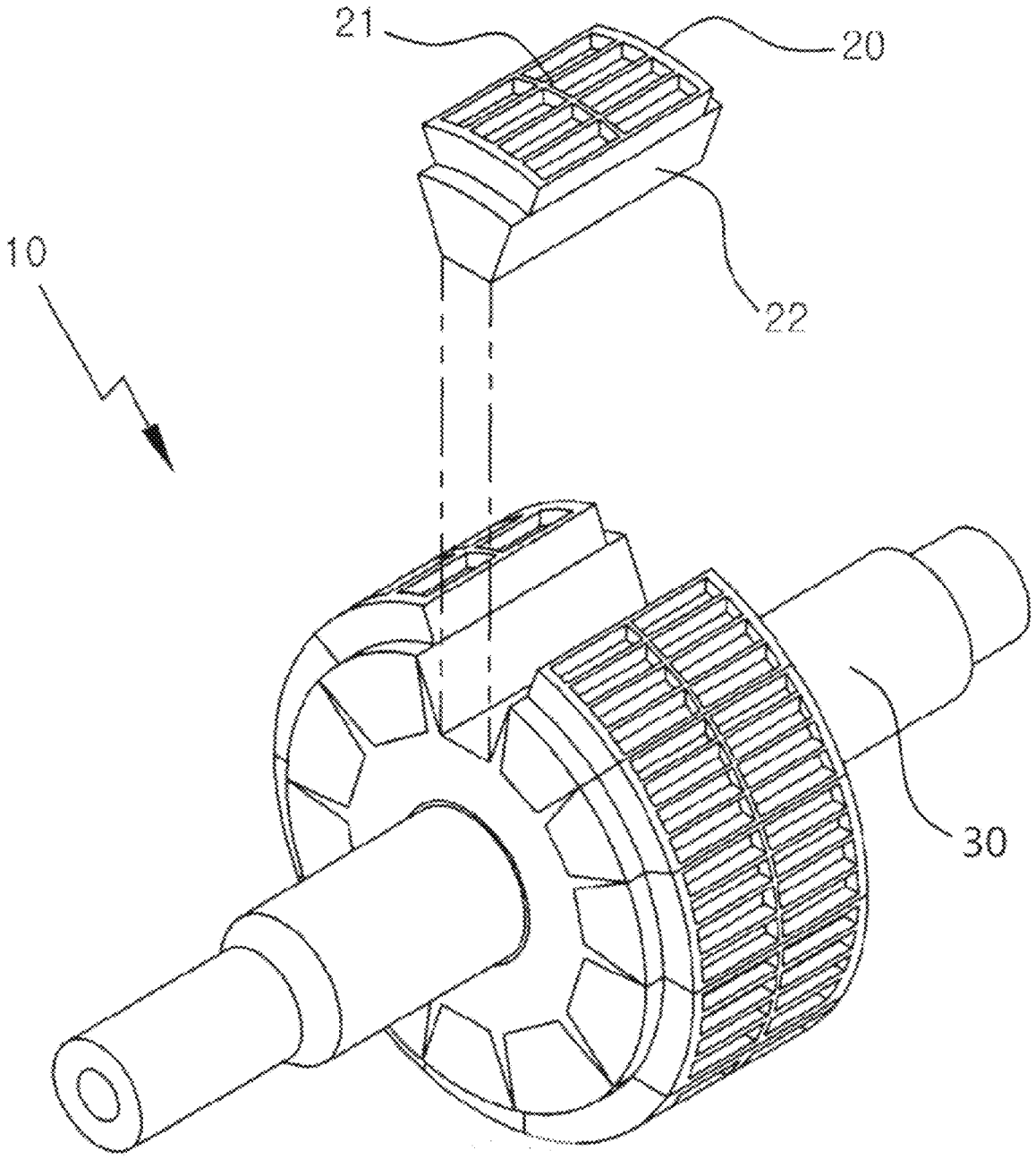
FIG. 1 is a perspective view showing a conventional forming roller.
Figure 2:
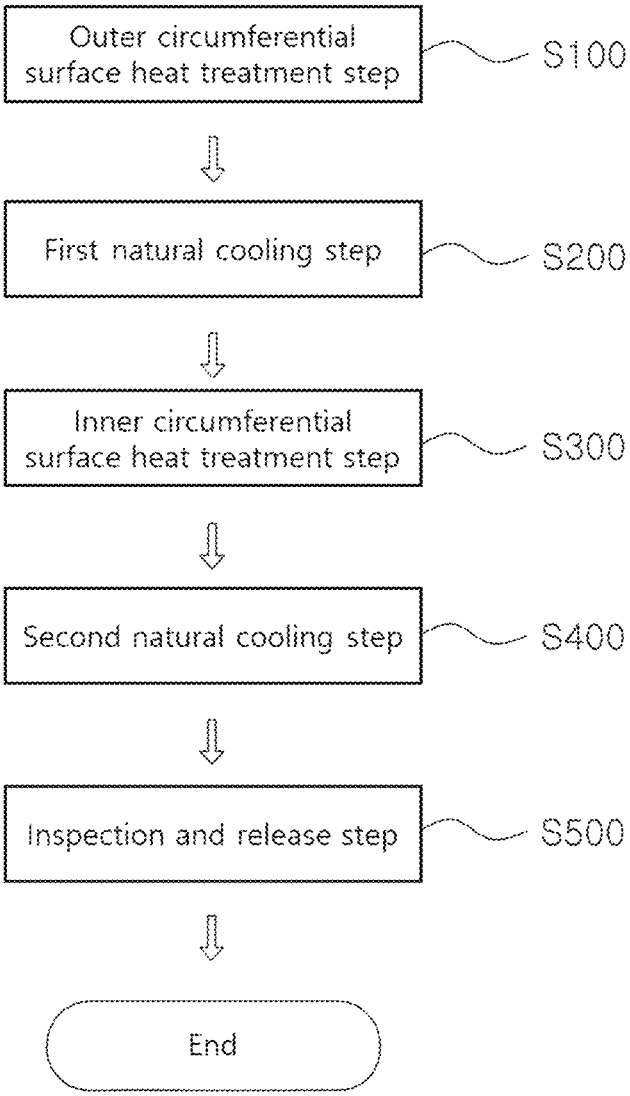
FIG. 2 is a block diagram showing an exemplary heat treatment process according to the present invention.
Figure 3:
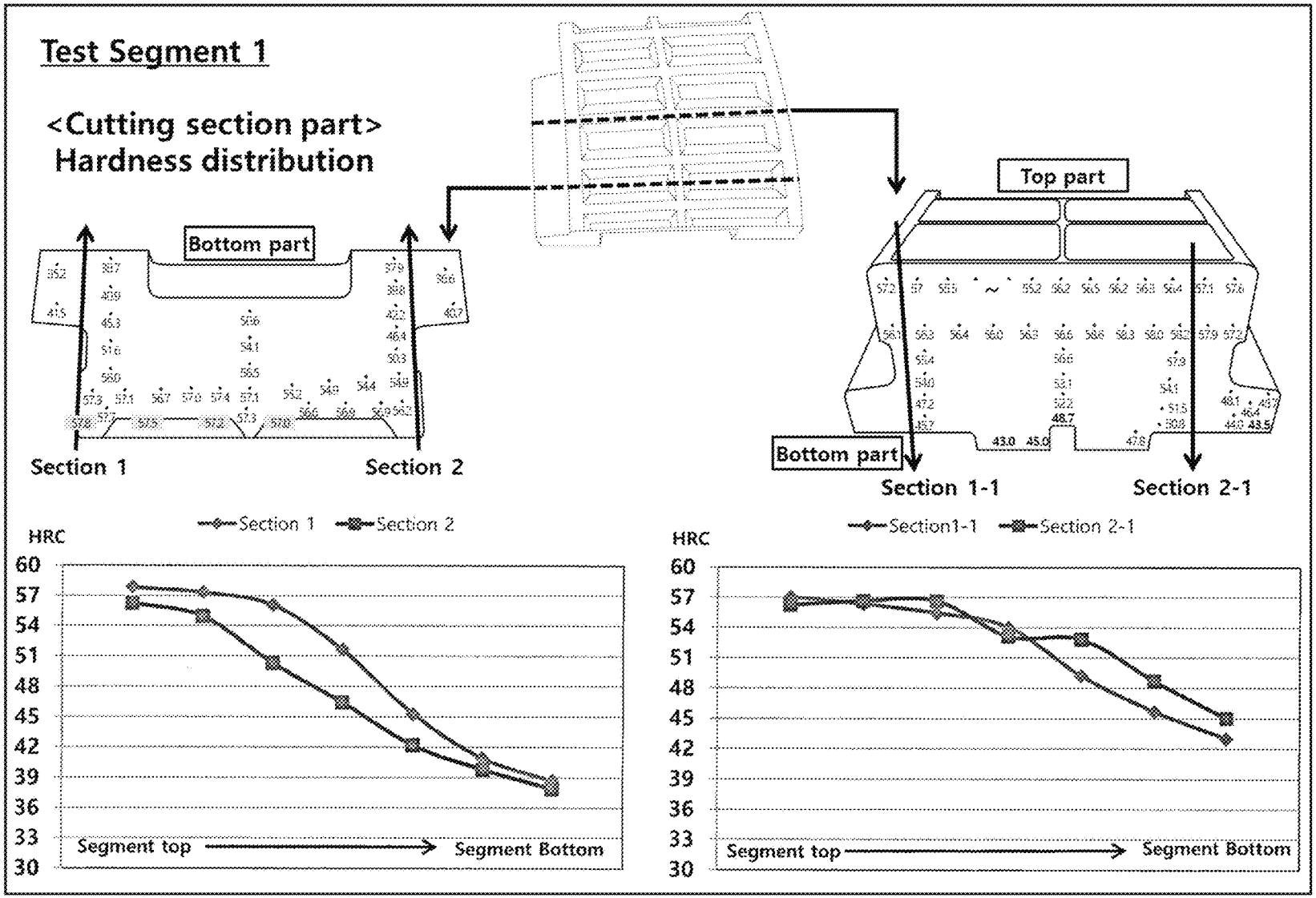
FIGS. 3 to 6 are hardness result tables obtained by inspecting hardness of a sample roller unit.
Figure 4:
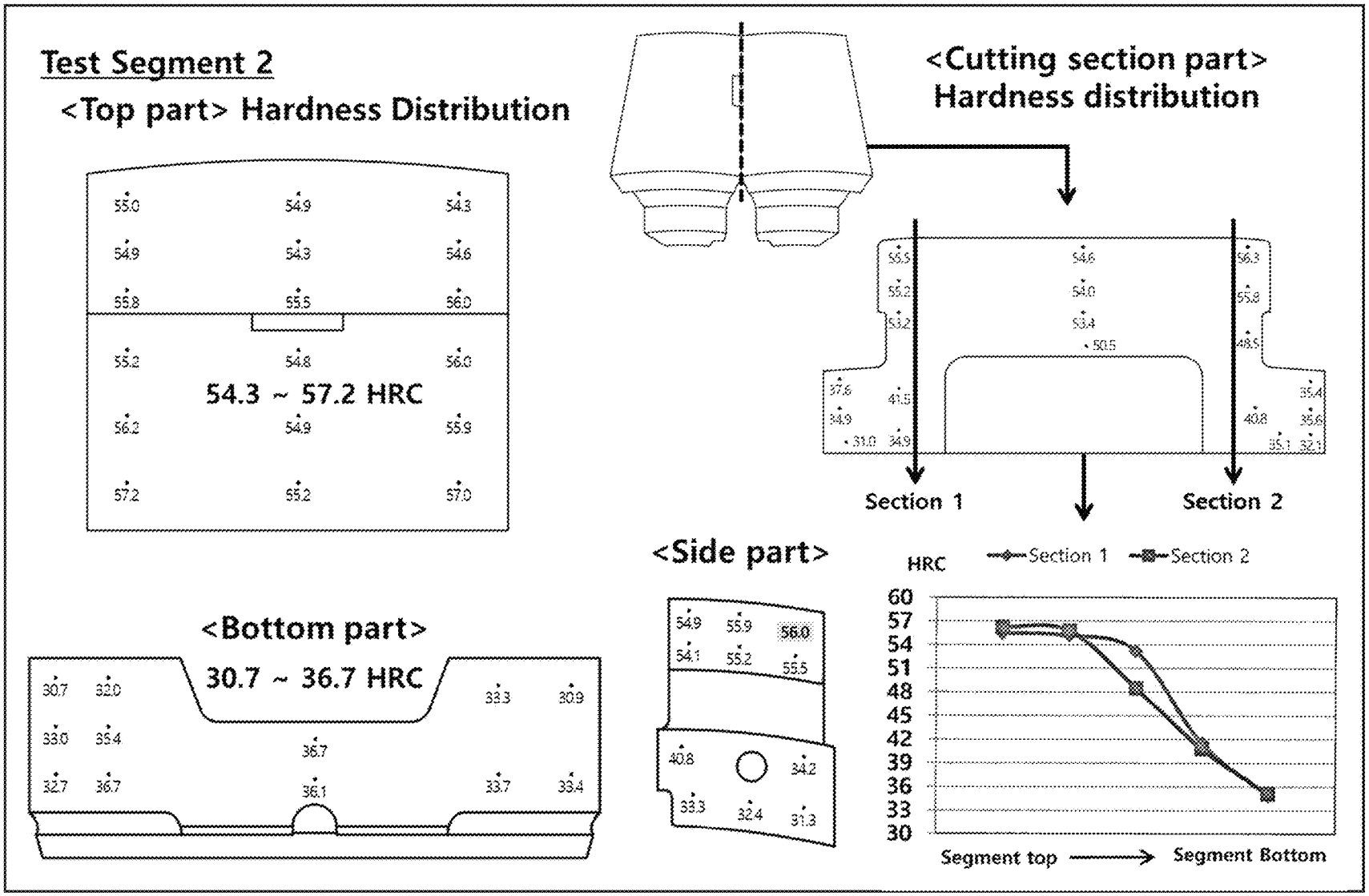
Figure 5:
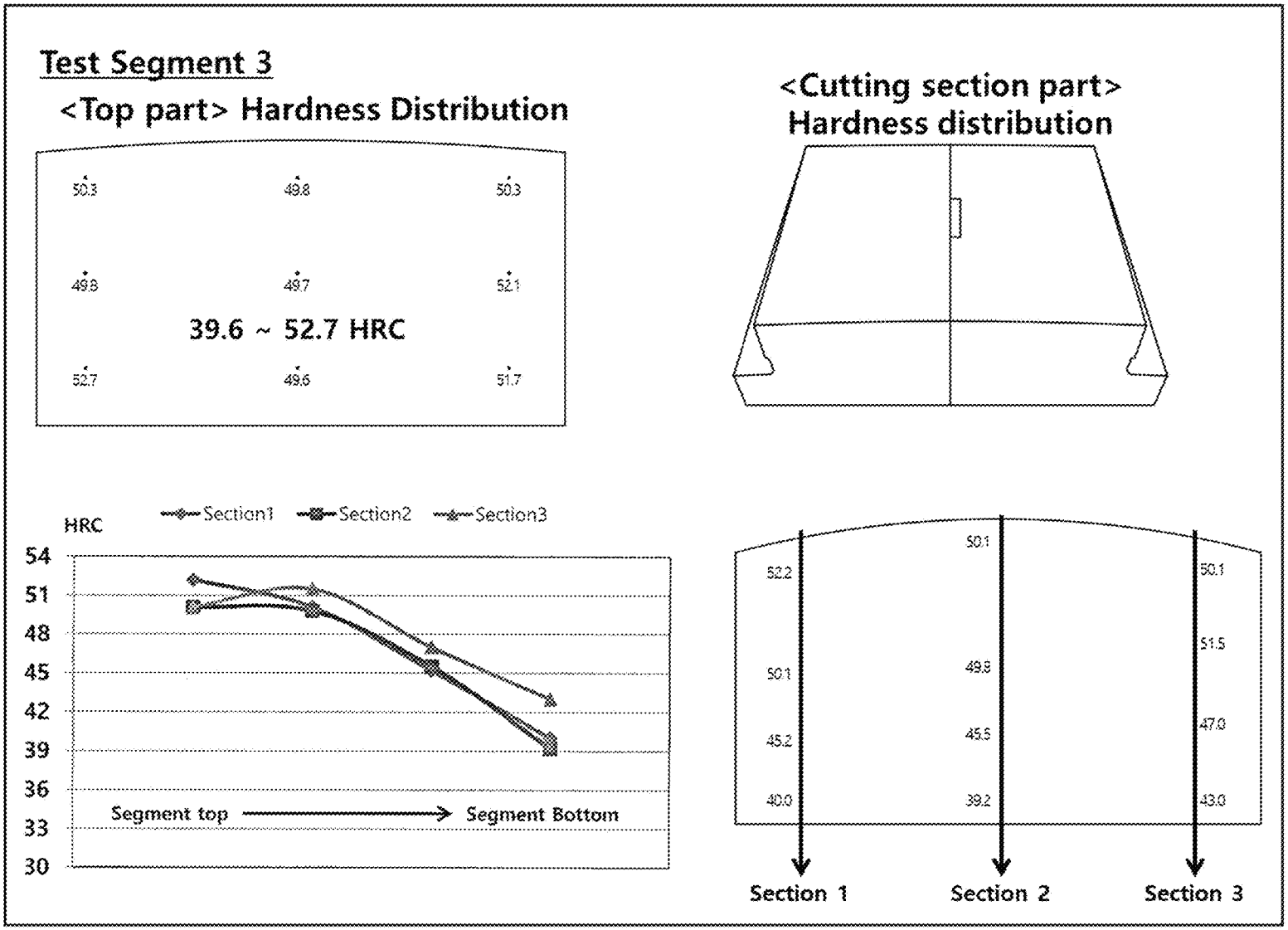
Figure 6:
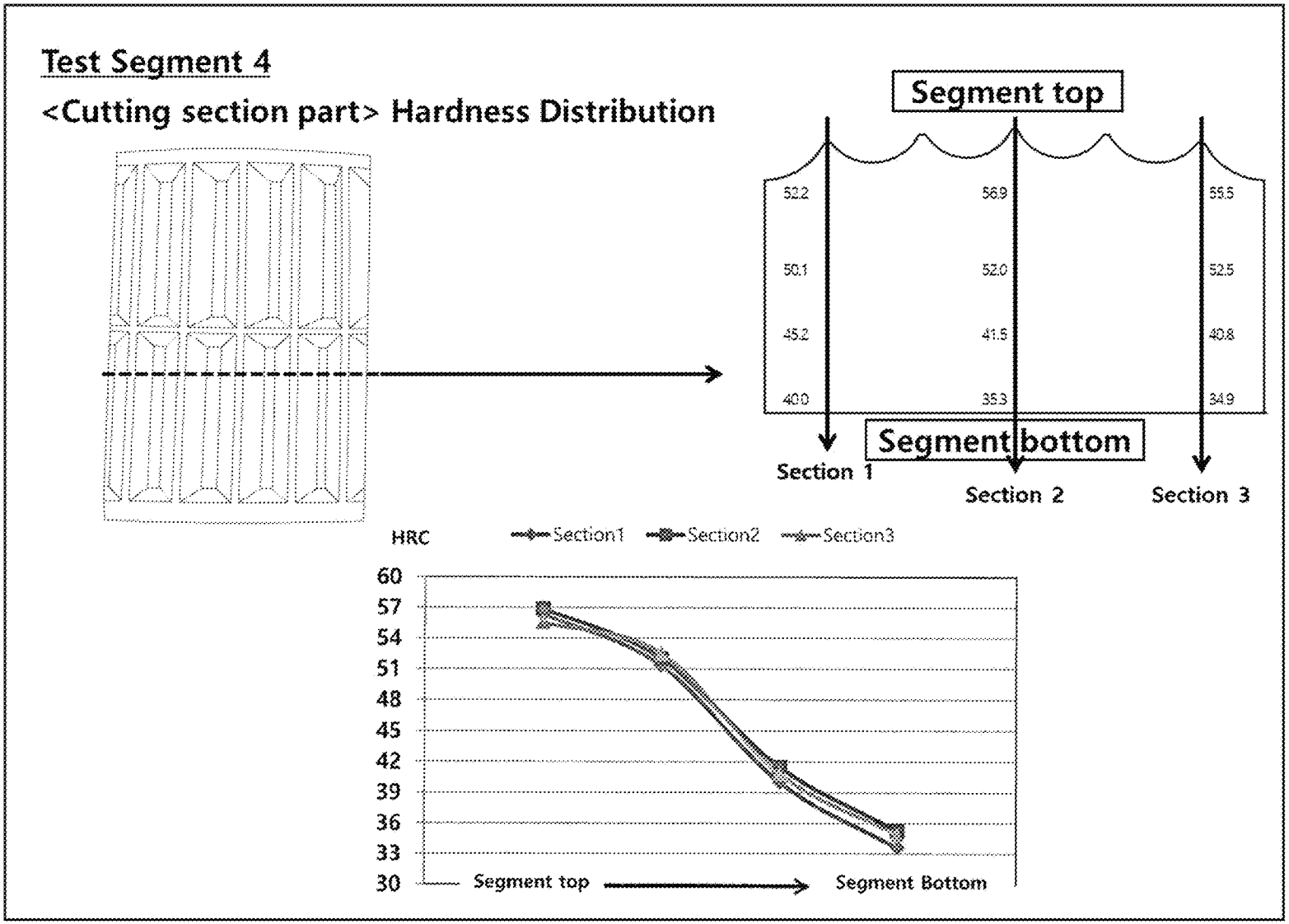

First, as shown in FIG. 2, in the differential heat treatment method for the forming roller according to the present invention, an outer circumferential surface 21 of a roller unit 20 constituting a forming roller 10 may be heated such that a heat treatment is performed under a condition of a temperature of 1150 to 1200° C. for 25 to 35 minutes (S100).

After the outer circumferential surface heat treatment, first natural cooling may be performed until a surface temperature reaches 100 to 150° C. (S200), and, after the natural cooling, an inner circumferential surface 22 of the roller unit 20 may be heated such that a heat treatment is performed under a condition of a temperature of 680 to 730° C. for 35 to 45 minutes (S300).

After the inner circumferential surface heat treatment, second natural cooling may be performed until the roller unit reaches a room temperature state (S400), and, after the second cooling, hardness of the outer circumferential surface and the inner circumferential surface may be inspected to perform release when the hardness is within an error range (S500), thereby completing a heat treatment process.

In this case, the heating may be performed to perform the heat treatments on the outer circumferential surface and the inner circumferential surface, respectively, by using gas as a heat source after insertion into a heating furnace or using electricity as a heat source.

As shown in FIGS. 3 to 6 and 7, when the heat treatment is performed as described above, the hardness of the outer circumferential surface may be 52 to 60 HRC, and the hardness of the inner circumferential surface may be 31 to 39 HRC, so that the hardness may have a significant difference. Due to the difference, abrasion of the outer circumferential surface may be delayed, which may extend a lifespan and improve productivity, and wearing-away of the inner circumferential surface upon friction with a component that rotates while making surface contact may be reduced, which may improve durability.

In addition, a material of the roller unit 20 may be one selected from high-speed tool steel, alloy tool steel, and special-purpose steel.

The high-speed tool steel may be a steel material to which a relatively large amount of an alloy element such as tungsten, molybdenum, cobalt, chromium, and vanadium is added in combination, and may be mainly used for a cutting tool. Since the high-speed tool steel excellently withstands frictional heat generated during high-speed cutting and has high hardness at a high temperature so as to enable high-speed cutting, the high-speed tool steel may be referred to as high-speed steel (HSS), and a type of the high-speed tool steel may include tungsten-based steel (SKH2, SKH3, SKH4, and SKH10), molybdenum-based steel (SKH50 to SKH59), and powder metallurgy molybdenum-based steel (SKH40).

Symbols of the alloy tool steel have been standardized and used as STD/STS in KS and SKD/SKS in JIS, a material called STD11 may refer to alloy tool steel for a cold die, and the alloy tool steel may be classified into alloy tool steel for a cutting tool, impact-resisting tool steel, a cold die, and a hot die in the KS standard.

The special-purpose steel may be steel for special purposes, which is a steel material for special purposes, and may have a type such as tool steel, hollow drill steel, bearing steel, stainless steel, heat-resisting steel, superalloy, spring steel, free-cutting steel, and clad steel in KS.

Although the embodiments of the present invention have been described above, various modifications and changes can be made to the present invention by a person having ordinary skill in the art through supplement, change, removal, addition, and the like of components within the scope that does not depart from the idea of the present invention described in the appended claims, and such modifications and changes will also fall within the scope of the present invention.

The invention claimed is:

1. A differential heat treatment method for a forming roller, the differential heat treatment method comprising:

an outer circumferential surface heat treatment step (S100) of heating an outer circumferential surface (21) of a roller unit (20) constituting a forming roller (10) such that a heat treatment is performed under a condition of a temperature of 1150 to 1200° C. for 25 to 35 minutes;

a first natural cooling step (S200) of performing, after the outer circumferential surface heat treatment, natural cooling until a surface temperature reaches 100 to 150° C.;

an inner circumferential surface heat treatment step (S300) of heating, after the natural cooling, an inner circumferential surface (22) of the roller unit (20) such that a heat treatment is performed under a condition of a temperature of 680 to 730° C. for 35 to 45 minutes;

a second cooling step (S400) of performing, after the inner circumferential surface heat treatment, natural cooling until the roller unit reaches a room temperature state; and an inspection and release step (S500) of inspecting, after the second cooling, hardness of the outer circumferential surface and the inner circumferential surface to perform release when the hardness is within an error range.

2. The differential heat treatment method of claim 1, wherein a material of the roller unit (20) is high-speed tool steel, alloy tool steel, or special-purpose steel.

3. The differential heat treatment method of claim 1, wherein a heat source in the heating process is gas or electricity.

* * * * *